United States Patent [19]

Hayashi et al.

[11] 4,049,538

[45] Sept. 20, 1977

[54] PROCESS FOR PRODUCING HIGH-CRYSTALLINE PETROLEUM COKE

[75] Inventors: Kiyoshige Hayashi, Tokyo; Mikio Nakaniwa, Ohme; Nobuyuki Kobayashi, Ichihara; Minoru Yamamoto, Ichihara; Yoshihiko Hase, Ichihara, all of Japan

[73] Assignee: Maruzen Petrochemical Co. Ltd., Tokyo, Japan

[21] Appl. No.: 613,541

[22] Filed: Sept. 15, 1975

[30] Foreign Application Priority Data

Sept. 25, 1974 Japan ..... 49-110316

[51] Int. Cl.[2] ..... C10G 9/14

[52] U.S. Cl. ..... 208/50; 208/125; 208/131

[58] Field of Search ..... 208/50, 131, 125

[56] References Cited

U.S. PATENT DOCUMENTS

| | | | |
|---|---|---|---|
| 2,182,599 | 12/1939 | Seguy | 208/50 |
| 2,271,097 | 1/1942 | Ruthruff et al. | 208/50 |
| 2,873,244 | 2/1959 | Hemminger | 208/50 |
| 3,472,761 | 10/1969 | Cameron | 208/131 |
| 3,687,840 | 8/1972 | Sze et al. | 208/50 |
| 3,803,023 | 4/1974 | Hamner | 208/131 |

*Primary Examiner*—Herbert Levine
*Attorney, Agent, or Firm*—Larson, Taylor and Hinds

[57] ABSTRACT

A high-crystalline petroleum coke is produced from low-sulfur petroleum feedstock such as virgin crude oil, distillation residuum and cracked residium by subjecting the feedstock to preheat treatment under specific conditions to effect cracking and soaking thereof, subjecting the preheat-treated feedstock to flash distillation to remove non-crystalline substances contained therein as pitch and to recover distillate, fractionating the distillate to provide a heavy residue and subjecting the heavy residue to a delayed coking under specific conditions to produce the desired coke which has a coefficient of thermal expansion of less than $1.0 \times 10^{-6}/°$ C over 100°–400° C.

6 Claims, 1 Drawing Figure

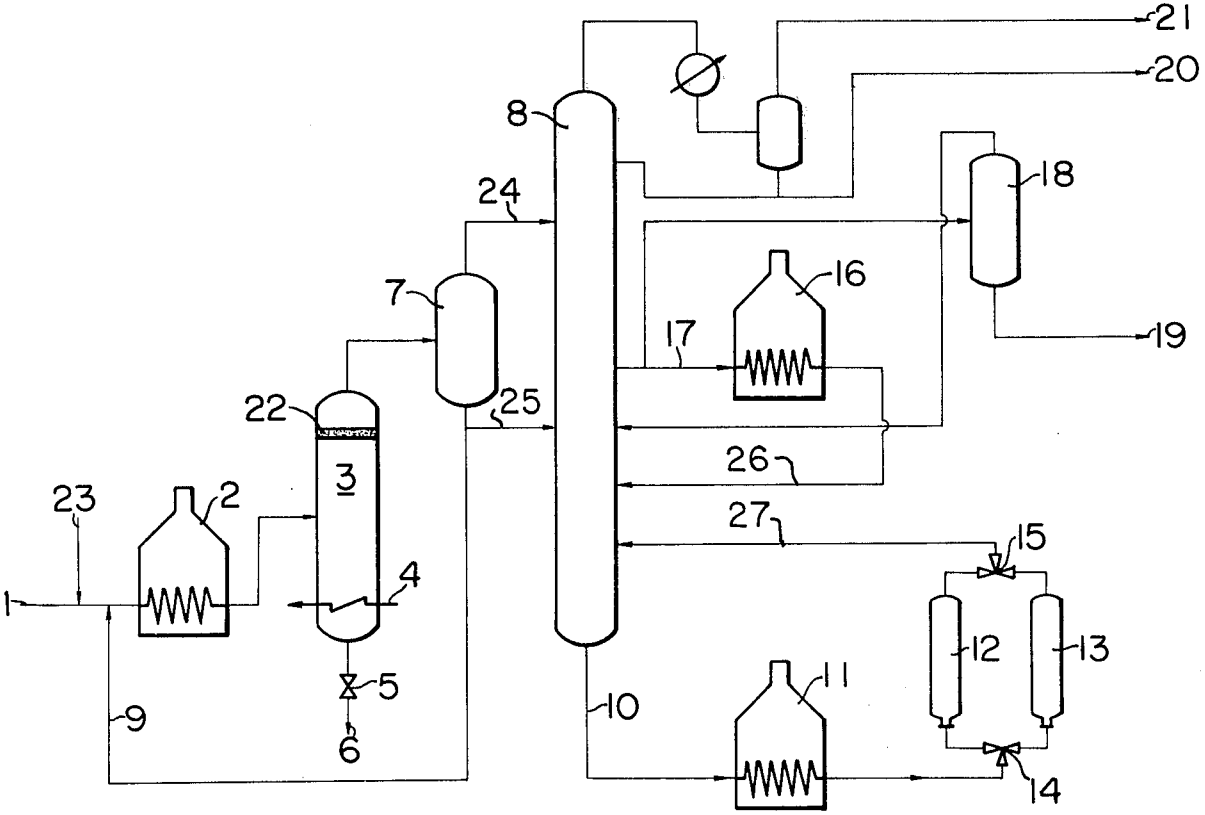
21
20
19
18
16
17
26
27
13
15
14
12
11
10
8
24
25
7
4
5
6
3
22
2
9
23
1

PROCESS FOR PRODUCING HIGH-CRYSTALLINE PETROLEUM COKE

This invention relates to a process for the production of a high-crystalline petroleum coke by treating in a delayed coking manner a feedstock of petroleum origin including a low-sulfur, virgin crude oil, a low-sulfur distillation or cracked residuum and a hydrodesulfurized residuum of distillation or cracking.

There have already been proposed various processes for producing a premium grade coke from a virgin crude oil, topped residue or vacuum residue and the cokes thus obtained have, in principle, been suited for the purpose of the production of graphite electrodes. At present, however, with the rapid progress of electric furnace smelting, requirement for the quality of premium grade coke is becoming more severe. Furthermore, the progress of steel-making technique using iron pellets and of electric furnace method essentially requires higher quality synthetic graphite electrodes suited for ultra-high power electric furnace steel-making, for which purpose such a higher quality of petroleum coke will be most suitable as material. Therefore, the development of new techniques for producing a petroleum coke of higher quality than that of commercially available premium grade coke, which is suited for large-scale operation in a simple manner with higher reproducibility at reasonable costs, has been eagerly desired in the art. For convenience sake, such a higher quality coke than the premium grade one is called hereinafter high-crystalline coke in view of its textural appearance being more highly crystalline than premium grade one.

It is the primary object of this invention to provide a new, simple process for producing a petroleum coke of higher-crystalline grade in a high yield at reasonable cost from a wide variety of petroleum materials including those from which a premium grade coke could never been obtained in the prior art. To achieve the said object, the present invention provides a new method for efficient removal of non-crystalline carbon-forming substances (hereinafter referred to as non-crystalline substances) from petroleum materials to be directed for the production of coke by subjecting such petroleum materials to previous heat-treatment for effecting cracking and soaking thereof followed by subjecting the materials to high-temperature flash distillation to remove the non-crystalline substances contained therein as pitch, the pitch being utilized for various applications.

It is apparent that in order to obtain a high-crystalline coke from a petroleum feedstock containing a substantial amount of non-crystalline substances, complete and efficient removal of the non-crystalline substances is necessary, but no economical success has been achieved as yet for this purpose. Thus, a heat-treatment of the starting feedstock or recycling of a thermal tar to the feedstock was ineffective for the removal of non-crystalline substances. Incorporation of an oil or tar containing no such non-crystalline substances into the feedstock would really result in lowering the concentration of non-crystalline substances, but no appreciable improvement in the crystallinity of coke was obtained. A process wherein a heavy petroleum residuum is heat-treated in the presence of absence of a catalyst, then a part of the residuum thus heat-treated is removed by filtration, distillation, centrifugation, extraction and the like and thereafter the residuum remained is subjected to delayed coking was effective to a certain extent, but still insufficient for the complete removal of non-crystalline substances, thus resulting in the formation of not a premium grade but a regular grade coke at most and in a low yield if the feedstock used contains a substantial amount of non-crystalline substances. A variant of the last-mentioned process wherein the heat-treatment of the starting petroleum residuum is effected by a delayed coking operation was also still insufficient, when applied to a petroleum residuum containing a substantial amount of non-crystalline substances, for the selective removal of the non-crystalline substances in the said first coking stage, possibly due to the coprecipitation of crystalline carbon-forming substances with non-crystalline ones in the form of a coke occurring in the first coking stage and also due to the contamination, with non-crystalline substances, of uncoked product in that stage which is to be coked in the second stage to form a premium grade coke, thus inevitably bringing the lowering in both the yield and quality of the coke obtained in the second coking stage. Similar disadvantages were more or less unavoidable in other two-stage delayed coking processes such as one wherein three coking drums are alternately used for the production of two types of coke and one wherein a petroleum starting material is subjected to a serial two-stage delayed coking when the starting material contains a substantial amount of non-crystalline substances.

We have made many studies on the removal of non-crystalline substances from petroleum feedstocks for the production of premium grade or higher grade coke and now successfully established a new process for the production of a high-crystalline coke by taking such steps before delayed coking that the feedstock is first heated in a tube heater and made to stay therein under certain limited conditions thereby to effect cracking and soaking of the feedstock and then subjected to a flash-distillation under certain limited conditions thereby to remove selectively non-crystalline substances contained in the feestock as pitch to provide a refined heavy oil satisfactorily suited as material for the delayed coking intended.

According to the present invention, therefore, we provide a process for producing a high-crystalline petroleum coke from a petroleum feedstock selected from the group consisting of a vrigin crude oil having a sulfur content of 0.4% by weight or less, a distillation residue derived from the crude oil, a cracked residue having a sulfur content of 0.8% by weight or less and a hydrodesulfurized product having a sulfur content of 0.8% by weight or less of any residue from a distillation or cracking of petroleum, which comprises the steps of:

1. heating the petroleum feedstock in a tube heater to a temperature of 430°–520° C under a pressure of 4–20 Kg/cm²G;

2. maintaining the feedstock in the tube heater at that temperature for 30–500 seconds to effect cracking and soaking thereof;

3. introducing the feedstock thus heat-treated into a high-temperature flashing column, where a flash-distillation is effected at a temperature of 380°–480° C under a pressure of 0–2 Kg/cm²G;

4. continuously removing non-crystalline substances contained in the feedstock as pitch from the bottom of the flashing column;

5. fractionating in a fractionating column the distillate from the flashing column into cracked gas, gasoline, kerosene, gas oil and heavy residue; and 6. introducing the heavy residue, after heating to a temperature required for the subsequent delayed coking, into a coking drum, where it is subjected to delayed coking at a temperature of 430°–460° C under a pressure of 4–20 Kg/cm²G for at least 20 hours, preferably at least 30 hours, thereby forming a high-crystalline petroleum coke having a coefficient of thermal expansion in the direction parallel to the extrusion of less than $1.0 \times 10^{-6}$/° C over 100°–400° C when measured in the form of a graphite artefact thereof.

In this process, the steps (1) to (5) are of a pre-treatment of the feedstock to be subjected to a delayed coking in the step (6) and therefore referred to hereinafter as the first stage of the process as a whole, the step (6) being the second stage of the process.

The first stage of the process of this invention was arranged as a result of our minute study on the relation in coking reaction between (1) feedstock and reaction conditions including temperature, pressure and time and (2) yield and properties of coke formed, from which was derived such discovery that non-crystalline substances contained in the petroleum feedstocks can be efficiently removed as pitch by taking a previous treatment comprising heating a petroleum feedstock containing a substantial amount of non-crystalline substances in a tube heater to a temperature of 430°–520° C under a pressure of 4–20 Kg/cm²G, maintaining the feedstock therein at that temperature for 30–500 seconds to effect cracking and soaking thereof and then subjecting the feedstock thus heat-treated to a flash distillation at a temperature of 380°–480° C under a pressure of 0–2 Kg/cm²G. The pitch removed from the flash-distillation step may, if desired, be subjected to a delayed coking operated at a temperature of 410°–430° C under a pressure of 2–10 Kg/cm²G to produce another coke. The coke thus obtained in a high yield (50–70% by weight) has appearance and texture like or close to amorphous carbon such as charcoal and activated carbon particularly when the feedstock contains a large amount of non-crystalline substances. This clearly suggests that the removal or separation of the non-crystalline substances from the petroleum feedstock was achieved very efficiently and economically by the adoption of the first stage of the process of this invention. The distillate thus obtained from the high temperature flash distillation is substantially free from such non-crystalline substances as a result of the selective and efficient removal thereof and therefore the heavy residual oil derived from the said distillate by subjecting it to fractionation to remove lighter fractions is satisfactorily suited as feedstock for the production of a high-quality coke. Thus, the heavy residual oil, when subjected to a delayed coking at a temperature of 430°–460° C under a pressure of 4–20 Kg/cm²G, gives a high-crystalline coke which has a degree of crystallinity significantly higher than that of premium-grade coke so-called and which is in higher yield.

We have further found as a result of a study on the influence of alkali or alkaline-earth metal salts on the coking reaction of hydrocarbon oils, particularly of heavy oils and residua that among those salts hydroxides and carbonates have a retarding action for pitch-forming and coking reactions of various heavy oils and residua in addition to an accelerating action for the so-called water gas forming reactions including the reactions of heavy oil, pitch and coke with water.

We already found when we proposed a two-stage delayed coking method for producing a high-crystalline coke together with a non-crystalline coke that non-crystalline substances to be removed from feedstock in the first coking stage may be coked at a somewhat higher reaction rate than that of high-crystalline substances and this has in fact suggested the possibility of producing a premium grade coke by a two-stage delayed coking process. Since, however, the difference in the reaction rate between non-crystalline and high-crystalline substances was slight in usual processes, the selective separation of the non-crystalline substances was not necessarily easy. The success achieved in the present invention is believed to be principally the result of the removal of non-crystalline substances in the form of pitch by adopting the first stage of the process. Then, we tried to apply to the process of this invention the retarding action above-mentioned of hydroxides or carbonates of alkali or alkaline-earth metals on the pitch-forming and coking reactions of heavy oils and residua with the intention of improving the selectivity of the separation of non-crystalline substances as pitch from the feedstock, and have now found that the addition of said basic compound in an amount of 0.5–10% by weight to the feedstock to be used for the process of this invention further improves the quality of the coke with an additional advantage that the yield of pitch being non-crystalline substances is lowered. For example, when a cracked residue derived from the thermal cracking of gas oil for the production of ethylene was used as feedstock for the process of this invention, the coefficient of thermal expansion over 100°–400° C of the resulting coke when such a basic compound was added to the feedstock was a value 0.1–0.2 33 $10^{-6}$/° C lower than that of the coke obtained without said addition. The effect of the addition of said basic compound will be detailed in Examples 4 and 6 hereinafter given.

It is well-known that the quality or performance of synthetic graphite electrodes depends largely upon the graphitizability of coke from which the electrodes are made. Thus, the higher the crystallinity of coke, the higher the graphitizability thereof and there are several factors, such as coefficient of thermal expansion (CTE), degree of graphitization (*h/w*), real density, electric resistivity and others, as measures of evaluating the quality of coke. In general, the better the quality of coke, the lower the value of CTE, the higher the value of *h/w*, the higher the real density and the lower the electric resistivity thereof.

Typical properties of various grades of coke are shown in Table 1.

TABLE 1

| | Coefficient of thermal expansion (1) (CTE) over 100–400° C ($\times 10^{-6}$/° C) | Degree of graphitization (2) h/w | Real density (3) at 2500° C | Coefficient of cubic expansion (4) over 130–300° C ($\times 10^{-6}$/° C) |
|---|---|---|---|---|
| Non-crystalline coke | Above 5.0 | Below 2.0 | Below 2.00 | Above 15 |
| Regular grade coke (for general purposes) | 1.8–3.0 | 4.1–4.4 | Around 2.10 | |
| Regular grade coke (for electrodes) | 1.2–1.8 | 4.4–4.8 | Above 2.15 | 9.5–12 |

TABLE 1-continued

| | Coefficient of thermal expansion (1) (CTE) over 100–400° C ($\times 10^{-6}$/° C) | Degree of graphitization (2) h/w | Real density (3) at 2500° C | Coefficient of cubic expansion (4) over 130–300° C ($\times 10^{-6}$/° C) |
|---|---|---|---|---|
| Premium grade coke | 1.0–1.2 | 4.5–5.0 | Above 2.15 | 8–9.5 |
| High-crystalline coke | Below 1.0 | Around 5.0 | Above 2.15 | Below 8.0 |

(1) measured on a graphite artefact and in the direction parallel to the extrusion.
(2) measured on a calcined coke.
(3) measured on a graphitized coke.
(4) measured on a graphite artefact.

The degree of graphitization, ($h/w$), is calculated by the following formula:

$h/w$ = height of [002] peak / [002] peak width at half intensity

The [002] peak was measured on a sample of coke which was prepared by calcining the green coke at 1450° C by X-ray analysis under the following conditions:

| | |
|---|---|
| Target: | CuKα(Filter: Nickel) |
| Voltage and Current: | 30 KVP; 20mA |
| Current Voltage: | Proportional Counter, 1450 V |
| Count Full Scale: | 10000 c/s to 20000 c/s |
| Time Constant: | 2 sec. |
| Slit: | Divergence 1°; Receiving Slit: 0.15 mm |
| Scanning Speed: | 1°/min. |
| Chart Scanning Speed: | 2 cm/min. |

The sample for the measurement of X-ray diffraction was prepared by the following procedure: The calcined coke was pulverized and sieved out 350 mesh plus. A certain amount of this coke flour was put into an aluminum mount (15 mm in length × 20 mm in width × 1.5 mm in thickness), pressed under a given pressure and then used for the measurement.

The coefficient of thermal expansion was measured on a graphite artefact prepared from the coke by the following procedure: The calcined green coke was pulverized into particle size fractions of 35–65 mesh and 100 mesh plus. The coke grist used in making the test artefact contained 40 parts of the former fraction and 60 parts of the latter fraction. Seventy parts of the coke composite and 30 parts of coal tar pitch were well mixed and the mixture was extruded through a hydraulic extruder to form a green extruded rod of 20 mm in diameter. The green extrudate was packed in carbon powder and slowly bake to form a baked artefact. The baking schedule consisted of increasing the temperature in linear fashion to 1000° C over a period of 8 hours and keeping that temperature for 3 hours. Graphitization of the artefact was carried out in a graphite tube resistance furnace at 2600° C for 1 hour.

The non-crystalline coke corresponds to "hard carbon" so-called, such as charcoal and activated carbon and as far as we known such a type of coke has not been obtained from a petroleum origin. Most of petroleum cokes and pitch cokes which are generally called as "soft carbon" fall within the class of regular grade ones and the premium grade coke is rather a special class for petroleum cokes and the high-crystalline coke is much more rare. Even in the production of premium grade coke from a feedstock of petroleum origin, it was necessary to solve various difficulties involving the purification of feedstock and coke-forming conditions. This will evidence the process of this invention to be quite unique and advantageous over the prior art processes in such point that it gives not only premium grade but also higher grade, namely high-crystalline coke having a value of CTE (in the direction parallel to the extrusion) of less than $1.0 \times 10^{-6}$/° C over 100°–400° C in economical and efficient way, details of which will be illustrated later.

The essence of this invention can be more readily understood by reference to the attached drawing which displays a representative flow diagram of one specific embodiment of this invention. Referring now to the diagram, a petroleum feedstock is introduced into tube preheater 2 through line 1 as it is or when desired after, a small amount of an alkali or alkaline earth metal hydroxide or carbonate is added through line 23 thereto. In the preheater, the feedstock is heated to a temperature of 430°–520° C under a pressure of 4–20 Kg/cm²G and maintained at that temperature for 30–500 seconds during which time cracking and soaking of the feedstock are effected. The feedstock thus heat-treated is introduced into flashing column 3 where it is subjected to flash distillation. At the bottom of the flashing column 3 a heating medium 4 is circulated to keep the bottom temperature at 410°–430° C, thereby 410°–430° C heavy fraction of the heat-treated feedstock is discharged from line 6 through valve 5 as pitch. The distillate free from the pitch in the flashing column 3 is introduced into main column 8 through lines 24 and 25. If the operating conditions of the preheater 2 become so severe that one-through pass of the feedstock to the preheater 2 is insufficient for effecting the intended heat-treatment or otherwise that the blockage of the tube heater is unavoidable, the operation of the preheat-treatment may be modified in such a manner that a gas-liquid separator 7 is provided between the flashing column 3 and the main column 8 as shown in the drawing to effect the condensation of a part of the pre-heated feedstock from which pitch has been removed and to recycle the condensate through line 9 to the inlet of the preheater 2 as combined feed, thus making the intended preheat-treatment complete under reasonable operating conditions of the preheater 2. The flashing column 3 is provided with a demister 22 to avoid the introduction into the main column of foreign and undesirable substances by entrainment with the distillate.

The feedstock introduced into the main column 8 through lines 24 and 25 is fractionated into gas, gasoline, gas oil fractions, leaving a heavy residue which is withdrawn from the bottom of the column 8 as combined feed which is a mixture with a recycle oil derived from coking drum 12 or 13 through line 27 and if desired with a thermal tar derived from a thermal cracker 16 through line 26 and then passed through line 10 to coking preheater 11. The preheated feedstock is charged through switch valve 14 into a delayed coking drum 12 or 13 where it is coked at 430°–460° C under 4–20 kg/cm²G. The coke drum overhead discharged through switch valve 15 is returned to the main column 8 through line 27, where it is fractionated into gas, gasoline, gas oil and recycle oil. The gas is discharged at the top of column 8 through line 21, gasoline through line 20 and recycle oil is withdrawn through line 10 as combined feed which is a mixture with the fresh feed and if desired with the thermal tar as above-mentioned.

The coking drums 12 and 13 are alternately used for the delayed coking operation by switching over every 36 hours. While one is in operation, another is under discharging the coke formed and then under standing by.

The gas oil fraction derived from the coking drum through the main column 8 may be charged into thermal cracker 16 through line 17 where it is thermally cracked at 510°-550° C under 35-65 Kg/cm²G into gas, gasoline and thermal tar which are all recycled to the main column 8. The thermal tar is thus mixed at the bottom of the column with the fresh feedstock and recycle oil to increase the yield of coke. Alternatively, the gas oil fraction may directly be subjected to stripping in stripper 18 to remove lighter oil and recovered through line 19 for any desired application. In the latter case, the yield of coke based on the starting feedstock is lowered, but the quality of coke is not affected thereby.

The following Examples further illustrate, but not limit, this invention, in which percentages are by weight unless otherwise stated.

EXAMPLE 1

A thermal tar named as tar-bottom obtained as by-product in a conventional thermal cracking of gas oil for the purpose of producing ethylene which has sulfur content of 0.76% (the properties of which being shown in Table 2) was used as feedstock for this Example.

The feedstock was introduced into a stainless steel tube heater having 4 mm inside diameter, 6 mm outside diameter and 20 m length which was externally heated by a heating medium, heated under a pressure of 4 Kg/cm²G to 450° C and maintained at this temperature for about 260 seconds. The feedstock was then introduced at the middle part of a high-temperature flashing column having 100 mm diameter and 1000 mm height which was externally heated by electric wire heater, where the flash distillation of the feedstock was effected at 450° C under 0 Kg/cm²G to recover distillate as overhead and to withdraw pitch at the bottom of column in an amount of 24.6% based on the feedstock, with a retention time of about 10 minutes at the bottom of column, together with gas generated in an amount of 5% on the same basis. The distillate was then passed through a tube heater having inside and outside diameters of 4 mm and 6 mm, respectively, to preheat to the temperature required for the subsequent coking and charged into a coking drum, where it was subjected to delayed coking at 435° C under 9.0 Kg/cm²G for 38 hours, yielding 28.5% of coke based on the charge (20.0% based on the feedstock). By-products of the coking were 11.5% gas (8.1%), 25.4% gasoline boiling up to 200° C (15.2%), 28.9% gas oil boiling in the range 200°-300° C (17.3%) and 5.7% heavy oil boiling 300° C+ (3.4%).

The properties of coke obtained above are shown in Table 3. The coke was clearly classified under high-crystalline grade.

EXAMPLE 2

A thermal tar named as ethylene-bottom obtained as by-product in a conventional thermal cracking of naphtha for the purpose of producing ethylene, having sulfur content of 0.02% (the properties of which being shown in Table 2) was used as feedstock for this Example.

The feedstock was introduced into a stainless steel tube heater same as that used in Example 1 and heated under a pressure of 4 Kg/cm²G to 430° C and maintained at this temperature for about 260 seconds. The feedstock thus heat-treated was introduced at the middle part of a high-temperature flashing column same as that used in Example 1 and subjected to flash distillation under conditions of 400° C and 0 Kg/cm²G to recover distillate as overhead and to withdraw pitch at the bottom of column in an amount of 17.7% based on the feedstock, with a retention time of about 10 minutes at that bottom, together with gas generated in an amount of 2.6% on the same basis. The distillate was passed through the tube heater same as that used in Example 1 to preheat to the temperature for the subsequent coking and charged into a coking drum where it was subjected to delayed coking at 435° C under 9.0 Kg/cm²G for 38 hours, yielding 21.0% of coke based on the charge (16.7% based on the feedstock). By-products of the coking were 7.3% gas (5.8%), 25.1% gasoline boiling up to 200° C (20.1%), 32.3% gas oil boiling in the range 200°-300° C (25.7%) and 14.3% heavy oil boiling 3000° C+ (11.4%).

The properties of coke thus obtained are shown in Table 3. The coke was similarly classified under high-crystalline grade.

EXAMPLE 3

A topped residue of Minas crude oil (the properties of which being shown in Table 2) was used as feedstock for this Example.

The feedstock was introduced into a stainless steel tube heater having 4 mm inside diameter, 6 mm outside diameter and 40 m length which was externally heated by a heating medium and heated under 20 Kg/cm²G to 480° C and maintained at this temperature for about 190 seconds. The feedstock thus heat-treated was introduced at the middle part of a high-temperature flashing column and subjected to flash distillation under conditions of 400° C and 0 Kg/cm²G to recover distillate as overhead and to withdraw pitch at the bottom of column in an amount of 10.7% based on the feedstock, with a retention time of about 15 minutes at that bottom, together with gas generated in an amount of 21.0% on the same basis. The distillate was passed through a tube heater same as that used in Example 1 to preheat to the temperature required for the subsequent coking and charged into a coking drum where it was subjected to delayed coking at 435° C under 9.0 Kg/cm²G for 38 hours, yielding 5.9% of coke base on the charge (4.1% based on the starting feedstock). By-products of the coking were 18.2% gas (12.4%), 20.0% gasoline boiling up to 200° C (13.6%), 34.5% gas oil boiling in the range 200°-300° C (23.6%) and 21.4% heavy oil boiling 300° C+ (14.6%).

The properties of coke thus obtained are shown in Table 3. The coke was similarly classified under high-crystalline grade.

EXAMPLE 4

The procedure of Example 1 was repeated except that 0.5% based on the feedstock of sodium hydroxide were premixed with the feedstock in the form of an aqueous solution. At the flash distillation stage, pitch was removed in an amount of 17.0% together with 5.0% of gas. The coking stage gave a coke in a yield of 34.5% based on the charge (26.9% based on the feedstock) and as by-products 15.2% gas (11.9%) and 50.3% cracked oil (39.2%).

The properties of coke thus obtained are shown in Table 3. The comparison of Example 1 with Example 4 clearly demonstrates significant improvements in both the yield and quality of coke of Example 4 over Example 1.

EXAMPLE 5

Djatibarang virgin crude oil (the properties of which being shown in Table 2) was used a feedstock for this Example.

The feedstock was introduced into a stainless steel tube heater having 4 mm inside diameter, 6 mm outside diameter and 40 m length which was externally heated by a heating medium, heated under 20 Kg/cm²G to 480° C and maintained at this temperature for about 230 seconds. The feedstock thus heat-treated was introduced at the middle part of a high-temperature flashing column having 100 mm diameter and 1000 mm height which was externally heated by electric wire heater, where the flash distillation of the feedstock was effected at 400° C under 0 Kg/cm²G to recover distillate as overhead and to withdraw pitch at the bottom of column in an amount of 12.0% based on the feedstock, with a retention time of about 5 minutes at that bottom, together with gas generated in an amount of 10.0% on the same basis. The distillate was then passed through a tube heater having 4 mm inside diameter and 6 mm outside diameter to preheat to the temperature required for the subsequent coking and charged into a coking drum, where it was subjected to delayed coking at 435° C under 9.0 Kg/cm²G for 24 hours, yielding 10.1% of coke based on the charge (7.9% based on the feedstock). By-products of the coking were 9.8% gas (7.6%), 22.4% gasoline boiling up to 200° C (17.5%), 48.1% gas oil (37.5%) and 9.6% heavy oil boiling 300° C+ (7.5%).

The properties of coke obtained above are shown in Table 3. The coke was similarly classified under high-crystalline grade.

EXAMPLE 6

1. A hydrodesulfurized product containing 0.3% of sulfur from a cracked residue named as desulfurized tar which was obtained by hydrodesulfurizing the latter obtained as by-product in a conventional thermal cracking of gas oil for the purpose of producing ethylene (the properties of which being shown in Table 2) was used as feedstock for this Example.

The feedstock was introduced into a stainless steel tube heater having 4 mm inside diameter, 6 mm outside diameter and 30 m length which was externally heated by a heating medium, heated under 20 Kg/cm²G to 490° C and maintained at this temperature for about 250 seconds. The feedstock was then introduced at the middle part of a high-temperture flashing column having 100 mm diameter and 1000 mm height which was externally heated by electric wire heater, where the flash distillation of the feedstock was effected at 400° C under 0 Kg/cm²G to recover distillate as overhead and to withdraw pitch at the bottom of column in an amount of 7.9% based on the feedstock, with a retention time of about 10 minutes at the bottom, together with gas generated in an amount of 1.5% on the same basis. The distillate was then passed through a tube heater having 4 mm inside diameter and 6 mm outside diameter to preheat to the temperature required for the subsequent coking and charged into a coking drum, where it was subjected to delayed coking at 435° C under 9.0 Kg/cm²G for 38 hours, yielding 10.9% of coke based on the charge (9.9% based on the feedstock). By-products of the coking were 8.6% gas (7.8%), 5.0% gasoline boiling up to 200° C (4.5%), 50.4% gas oil (45.7%) and 25.1%) heavy oil boiling 300° C+ (22.7%).

The properties of coke thus obtained are shown in Table 3, which clearly show that the coke is of high-crystalline grade.

2. The same procedure as above was repeated except that 1.0% based on the feedstock of sodium carbonate was premixed with the feedstock in the form of an aqueous solution. The yield of coke thus obtained was increased to 11.5% based on the feedstock as well as the properties of coke being further improved as shown in Table 3.

Table 2

| | Tar-bottom (Example 1) | Ethylene-bottom (Example 2) | Minas topped residue (Example 3) | Djatibarang virgin crude oil (Example 5) | Desulfurized tar (Example 6) |
|---|---|---|---|---|---|
| Specific gravity (15°/4° C) | 1.0825 | 1.0684 | 0.883 | 0.885 | 1.028 |
| Carbon residue (wt %) | 17.7 | 12.8 | 4.5 | 8.9 | 6.7 |
| Sulfur content (wt %) | 0.76 | 0.02 | 0.22 | 0.17 | 0.3 |
| Wax content (wt %) | — | | 36.8 | 33.6 | — |
| Pour point (° C) | +20 | −12.5 | 47.5 | +45 | <−30 |
| Composition | | | | | |
| Paraffin content (vol %) | 5.6 | 5.6 | 64.1 | 62.0 | 16.5 |
| Aromatics content (vol %) | 88.7 | 81.7 | 31.0 | 24.6 | 81.3 |
| Resin content (vol %) | 1.5 | 0.7 | 0.5 | 0.5 | 0.6 |
| Residue (vol %) | 4.2 | 12.0 | 4.4 | 12.9 | 1.6 |
| Distillation | | | | | |
| I.B.P. ° C | 220 | 212 | | 95 | 195 |
| 5% | 245 | 224 | | 180 | 237 |
| 10% | 260 | 227 | | 240 | 250 |
| 50% | 345 | 313 | | 369 | 324 |
| 90% | — | — | | — | — |
| E.P. | 465 | 485 | | 378 | 513 |
| (Distillate %) | (88%) | (79%) | | (65%) | (85%) |

Table 3

| | Example 1 | Example 2 | Example 3 | Example 4 | Example 5 | Example 6 (1) | Example 6 (2) |
|---|---|---|---|---|---|---|---|
| Graphite artefact | | | | | | | |
| Graphitization condition | 2700° C × 0.5 hr | | | | | | |
| Coefficient of thermal expansion (CTE) (in the direction parallel to the extrusion) | | | | | | | |
| RT-125° C (× $10^{-6}$/° C) | 0.40 | 0.33 | 0.44 | 0.36 | 0.40 | 0.19 | 0.05 |
| 100-400° C (× $10^{-6}$/° C) | 0.99 | 0.83 | 1.00 | 0.84 | 0.88 | 0.71 | 0.61 |

Table 3-continued

| | Example 1 | Example 2 | Example 3 | Example 4 | Example 5 | Example 6 (1) | Example 6 (2) |
|---|---|---|---|---|---|---|---|
| Coefficient of cubic expansion 130–300° C ($\times 10^{-6}$/° C) | 7.88 | 7.65 | 7.93 | 7.30 | 7.85 | 7.66 | 6.35 |
| Electric resistivity ($\times 10^{-3}$ Ωcm) | 2.588 | 2.659 | | 2.414 | 2.632 | 2.907 | 2.548 |
| Calcined coke | | | | | | | |
| Calcination condition | | | | 1400° C × 3 hr | | | |
| Crushing strength (%) | 56.7 | 64.3 | 64.7 | 59.8 | 65.0 | 65.3 | 59.3 |
| Real density (g/cc) | 2.152 | 2.145 | 2.140 | 2.155 | 2.147 | 2.154 | 2.174 |
| Water content (wt %) | 0.05 | 0.06 | 0.10 | 0.07 | 0.07 | 0.18 | 0.15 |
| Ash content (wt %) | 0.05 | 0.05 | 0.05 | 0.06 | 0.06 | 0.06 | 0.02 |
| Volatile matter content (wt %) | 0.20 | 0.27 | 0.21 | 0.17 | 0.25 | 0.16 | 0.55 |
| Fixed carbon content (wt %) | 99.70 | 99.62 | 99.64 | 99.70 | 99.62 | 99.66 | 99.28 |
| Sulfur content (wt %) | 0.63 | 0.07 | 0.25 | 0.66 | 0.22 | 0.48 | 0.33 |
| Metal content (wt ppm) | | | | | | | |
| Fe | 28 | 12 | 25 | 8 | — | 49 | 25 |
| Ni | 2 | 2 | 1 | 1 | — | 4 | 3 |
| V | 1 | 2 | 3 | 5 | — | 1 | 1 |
| Cu | 2 | 3 | 5 | 3 | — | 1 | 2 |

What we claim is:

1. A process for producing a high-crystalline petroleum cole from a petroleum feedstock which comprises the steps of:

heating the petroleum feedstock in a tube heater to a temperature of 430°–520° C under a pressure of 4–20 Kg/cm²G and in the presence of a small proportion of a basic compound selected from the group consisting of hydroxides and carbonates of alkali and alkaline-earth metals;

maintaining the feedstock in the tube heater at that temperature for 30–500 seconds to effect cracking and soaking thereof;

introducing the feedstock thus heat-treated into a high-temperature flashing column, where a flash distillation is effected at high-temperative temperature of 380°–480° C under a pressure of 0–2 Kg/cm²G;

continuously removing non-crystalline substances contained in the feedstock as pitch from the bottom of the flashing column;

fractionating in a fractionating column the distillate from the flashing column into cracked gas, gasoline, gas oil and heavy residue; and introducing the heavy residue, after heating to a temperature required for the subsequent delayed coking, into a coking drum, where it is subjected to delayed coking at a temperature of 430°–460° C under a pressure of 4–20 Kg/cm² G for at least 20 hours, thereby forming a high-crystalline petroleum coke having a coefficient of thermal expansion in the direction parallel to the extrusion of less than $1.0 \times 10^{-6}$° C over 100°–400° C when measured in the form of an extruded graphite artefact thereof.

2. A process as claimed in claim wherein the basic compound is selected from the group consisting of sodium hydroxide and sodium carbonate.

3. A process as claimed in claim 1 wherein the basic compound is present in an amount of 0.5–10% by weight based on the feedstock.

4. A process as claimed in claim 1 wherein the time for which the temperature of the feedstock in a tube heater is maintained at 430°–520° C is 200–500 seconds.

5. A process as claimed in claim 1 wherein the time for which the delayed coking is carried out it at least 30 hours.

6. A process as claimed in claim 1 in which said feedstock comprises a member selected from the group consisting of a vrigin crude oil having a sulfur content of 0.4% by weight or less, a distillation residue drived from the crude oil, a cracked residue having a sulfur content of 0.8% by weight or less and a hydrodesulfurized product having a sulfur content of 0.8% by weight or less of any residue from a distillation or cracking of petroleum.

* * * * *